US007185507B2

(12) United States Patent
Maglinger et al.

(10) Patent No.: US 7,185,507 B2
(45) Date of Patent: Mar. 6, 2007

(54) ICE MAKING AND DISPENSING SYSTEM

(75) Inventors: Frank W. Maglinger, Evansville, IN (US); Nihat Cur, St. Joseph, MI (US); Marcus R. Fischer, St. Joseph, MI (US); Tushar Kulkarni, St. Joseph, MI (US); Jeffery J. Anselmino, St Joseph, MI (US); Ronald L. Voglewede, St Joseph, MI (US); James C. L. Guarino, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 59 days.

(21) Appl. No.: 10/973,509

(22) Filed: Oct. 26, 2004

(65) Prior Publication Data

US 2006/0086128 A1 Apr. 27, 2006

(51) Int. Cl.
*F25C 5/18* (2006.01)

(52) U.S. Cl. ..... 62/344; 62/441

(58) Field of Classification Search ..... 62/344, 62/440, 441

See application file for complete search history.

(56) References Cited

U.S. PATENT DOCUMENTS

| | | | | |
|---|---|---|---|---|
| 2,709,343 | A | 5/1955 | Muffly | 62/103 |
| 2,765,633 | A | 10/1956 | Muffly | 62/117.3 |
| 3,146,601 | A * | 9/1964 | Gould | 62/3.6 |
| 3,146,606 | A | 9/1964 | Grimes et al. | 62/233 |
| 3,744,270 | A | 7/1973 | Wilcox | 62/344 |
| 3,788,089 | A * | 1/1974 | Graves | 62/137 |
| 4,003,214 | A | 1/1977 | Schumacher | 62/340 |
| 5,117,654 | A * | 6/1992 | Steffenhagen | 62/344 |
| 5,375,432 | A * | 12/1994 | Cur | 62/320 |
| 5,758,512 | A | 6/1998 | Peterson et al. | 62/407 |
| 6,735,959 | B1 | 5/2004 | Najewicz | 62/3.63 |
| 6,945,068 | B2 * | 9/2005 | Kim et al. | 62/353 |
| 6,964,177 | B2 | 11/2005 | Lee et al. | 62/230 |
| 7,076,967 | B2 | 7/2006 | Lee et al. | 62/253 |
| 2005/0056043 | A1 | 3/2005 | Lee et al. | 62/344 |
| 2005/0061018 | A1 | 3/2005 | Kim et al. | 62/344 |

FOREIGN PATENT DOCUMENTS

| | | |
|---|---|---|
| JP | 50-69644 | 6/1975 |
| WO | 2004/085937 | 10/2004 |

* cited by examiner

*Primary Examiner*—William E. Tapolcai
(74) *Attorney, Agent, or Firm*—Robert O. Rice; John F. Colligan; Stephen Krefman

(57) ABSTRACT

An ice making and dispensing system suitable for making and dispensing ice through the refrigerator compartment door of a bottom freezer refrigerator. The ice maker and ice cube storage bin are located in an insulated sub-compartment in the refrigerator compartment. The insulated sub-compartment is maintained below 0° C. for forming and storing ice cubes. The insulated sub-compartment can be positioned adjacent the freezer compartment and can be cooled by below 0° C. air from the freezer compartment or from an auxiliary evaporator.

31 Claims, 14 Drawing Sheets

ICE MAKING AND DISPENSING SYSTEM

CROSS REFERENCE TO RELATED APPLICATIONS

This application is related to the following U.S. Patent Applications filed concurrently herewith: US20030256; US20030429; and US20030432.

BACKGROUND OF THE INVENTION

1. Field of the Invention

The invention relates to an ice making and dispensing system that relates to a bottom freezer refrigerator comprising an ice forming and dispensing apparatus positioned outside the freezer compartment.

2. Description of the Related Art

In today's household refrigerator market, there are three basic configurations to choose from: a bottom freezer refrigerator in which the refrigerator compartment is located above the freezer compartment, a top-mount refrigerator in which the freezer compartment is located above the refrigerator compartment, and a side-by-side refrigerator in which the refrigerator compartment and freezer compartment extend the entire height of the refrigerator.

Of these three configurations, the bottom freezer configuration is considered by many consumers to have the most convenient configuration since most consumers access the refrigerator compartment of a refrigerator far more frequently than the freezer compartment. The upper position of the refrigerator compartment in a bottom freezer configuration positions the majority of the contents of the refrigerator compartment at the standing height of the consumer, negating the need for the consumer to stoop or bend over to see or select items. Therefore, a combination refrigerator with the freezer on the bottom provides the user with the greatest convenience by providing the maximum fresh food compartment space at eye-level and within easy reach.

One of the most desired accessories for a household refrigerator is a through-the-door ice and water dispenser. A through-the-door ice and water dispenser is desirable because it greatly simplifies the process of retrieving ice cubes, i.e. it eliminates opening the door, removing the ice cube storage bin, separating and scooping ice cubes, and pouring the ice cubes into a glass. The feature also can be viewed as an energy saver, since the freezer door is not opened as often.

However, of these three configurations, only the side-by-side configuration typically offers a through-the-door ice and water system. The side-by-side configuration is well suited for through-the-door ice dispensing because the freezer door extends the height of the refrigerator cabinet, which permits the ice dispenser to be located in the freezer door at a height convenient for the user. In contrast, the top-mount and bottom freezer refrigerators have freezer door locations that would place the ice dispenser either too high or too low for convenient use by the consumer. In particular, locating the ice dispenser in a bottom freezer refrigerator involves two problems that must be overcome. First, if ice is made and/or stored in the refrigerator compartment, it will melt if not insulated from and chilled independently of the refrigerator compartment. Second, if ice is made and/or stored in the freezer compartment, it must be transported upwardly for dispensing through the ice and water dispenser.

With current ice making and dispensing technology, it has not been possible for a consumer to have the most convenient refrigerator configuration with the most desired accessory. In other words, bottom freezer refrigerators have not been available with through-the-door ice and water dispensing. Thus, it would be desirable to have an ice making and dispensing system that can be used to dispense the ice through the refrigerator compartment door of a bottom freezer refrigerator to provide the consumer with both the bottom freezer configuration and the through-the-door ice and water dispensing functionality.

SUMMARY OF THE INVENTION

The invention relates to refrigerator with a cabinet defining a freezer compartment maintained at a temperature below 0° C. and a refrigerator compartment maintained at a temperature above 0° C. and located above the freezer compartment having an insulated refrigerator door moveably mounted to the cabinet for selectively closing the refrigerator compartment and a refrigeration system for cooling the freezer compartment and the refrigerator compartment. The refrigerator includes an auxiliary freezer compartment located in the refrigerator compartment with an ice maker and an ice cube storage bin located in the auxiliary freezer compartment. An ice dispenser is located on the refrigerator door and an ice cube dispensing outlet located in the refrigerator door. The auxiliary freezer compartment is maintained at a temperature below 0° C. for forming and storing ice cubes.

The refrigerator door closes the auxiliary compartment when the refrigerator door closes the refrigerator compartment. The ice dispenser is located on the refrigerator door opposite the ice cube storage bin.

The auxiliary compartment includes a cooling element for cooling the auxiliary compartment below 0° C. The cooling element can be an air inlet for receiving air cooled below 0° C. for forming and storing ice cubes.

In another aspect the invention relates to an ice maker and dispenser for a bottom freezer refrigerator having a freezer compartment maintained at a temperature below 0° C., a refrigerator compartment maintained at a temperature above 0° C. positioned above the freezer compartment, an insulated refrigerator compartment door, and a refrigeration system for cooling the freezer compartment and the refrigerator compartment. An insulated sub-compartment is located in the refrigerator compartment and closed by the refrigerator door when the refrigerator door is closed. The automatic ice maker is located in the sub-compartment for generating ice cubes. The bottom freezer refrigerator includes a water supply for the ice maker, an ice cube storage bin; and an ice dispenser positioned on the refrigerator door to receive ice cubes from the ice cube storage bin and dispense ice cubes from the face of the refrigerator door. The ice maker and ice cube storage bin are provided with air cooled below 0° C. for forming and storing ice pieces.

The refrigerator door can include gaskets for sealing the insulated sub-compartment when the refrigerator door is closed.

The insulated sub-compartment can include a bottom wall that comprises a shelf to support items in the insulated sub-compartment.

The bottom freezer refrigerator includes an insulated compartment separator dividing the refrigerator compartment from the freezer compartment. The compartment separator and a bottom wall can form the insulated sub-compartment.

The bottom wall can include at least one passage connecting the insulated sub-compartment with the freezer compartment. A damper can be provided for selectively closing the passage to control the temperature in the insulated sub-compartment independent of the freezer compartment.

In another aspect the invention relates to a method of dispensing ice cubes through the refrigerator compartment door of a bottom freezer refrigerator having an icemaker positioned in an insulated sub-compartment positioned in the refrigerator compartment including operating the refrigeration system to provide cooling to the refrigerator and freezer compartments, maintaining temperatures below 0° C. in the insulated compartment, filling the ice maker with water and forming ice cubes, and operating the dispenser to dispense ice cubes through the refrigerator door.

An ice cube storage bin can be positioned in the insulated sub-compartment and the method can include the step of storing ice cubes harvested from the ice maker in the ice cube storage bin.

The method of dispensing ice cubes includes operating a mover in the ice cube storage bin to move ice cubes toward a dispenser outlet and to a dispensing mechanism on the refrigerator door.

DESCRIPTION OF THE INVENTION

The invention described herein relates to an ice dispensing unit for dispensing ice at a height convenient for a user, i.e. the user can retrieve ice while in a standing position, which is located above a freezer compartment. Several embodiments are described of an ice making and storage unit positioned outside the freezer compartment and can be positioned in a refrigerator compartment located above the freezer compartment.

It should be noted that the embodiments described hereinafter share many of the same elements, such as a refrigerator compartment, freezer compartment, refrigerator and freezer compartment doors, a dispensing outlet mounted in the refrigerator door, an ice maker, an ice cube storage bin, and the like. It will be understood that the operation of these elements will generally be the same for each embodiment, and a description of their operation will not be repeated for each embodiment, unless otherwise noted. As well, elements common to more than one embodiment will be identified with common numerals. Ice cubes are illustrated in the Figures as generally semicircular pieces of ice, although the inventive concepts described herein are not so limited, and are equally applicable to ice particles having a cylindrical, rectilinear, or other shape. The term refrigerator is generally used to refer to an appliance with having both a refrigerator compartment and freezer compartment.

Figure 1:
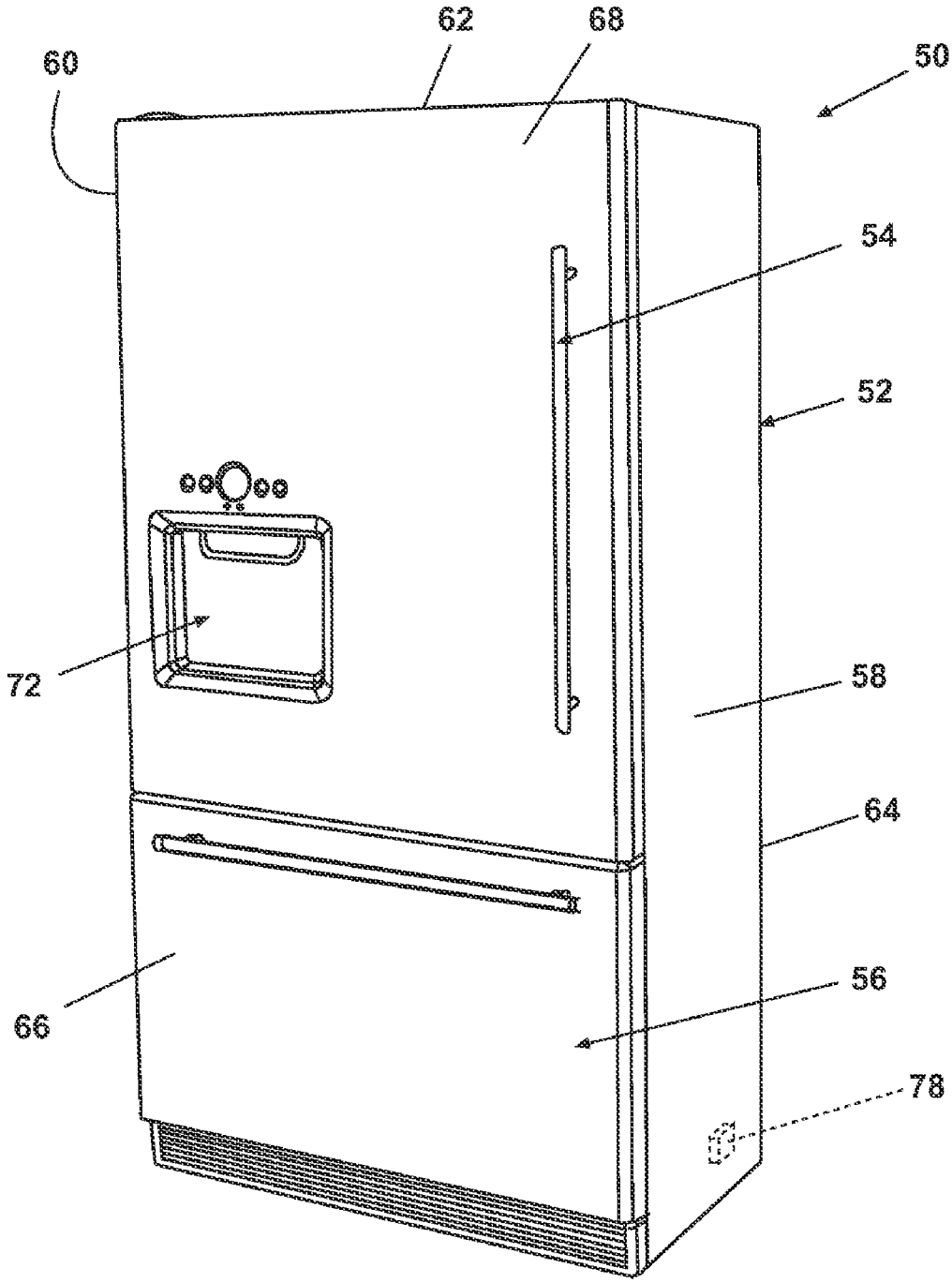
FIG. 1 is a perspective view of a bottom freezer refrigerator comprising one embodiment of an ice forming and dispensing unit providing through-the-door ice cube and water dispensing.
Figure 2:
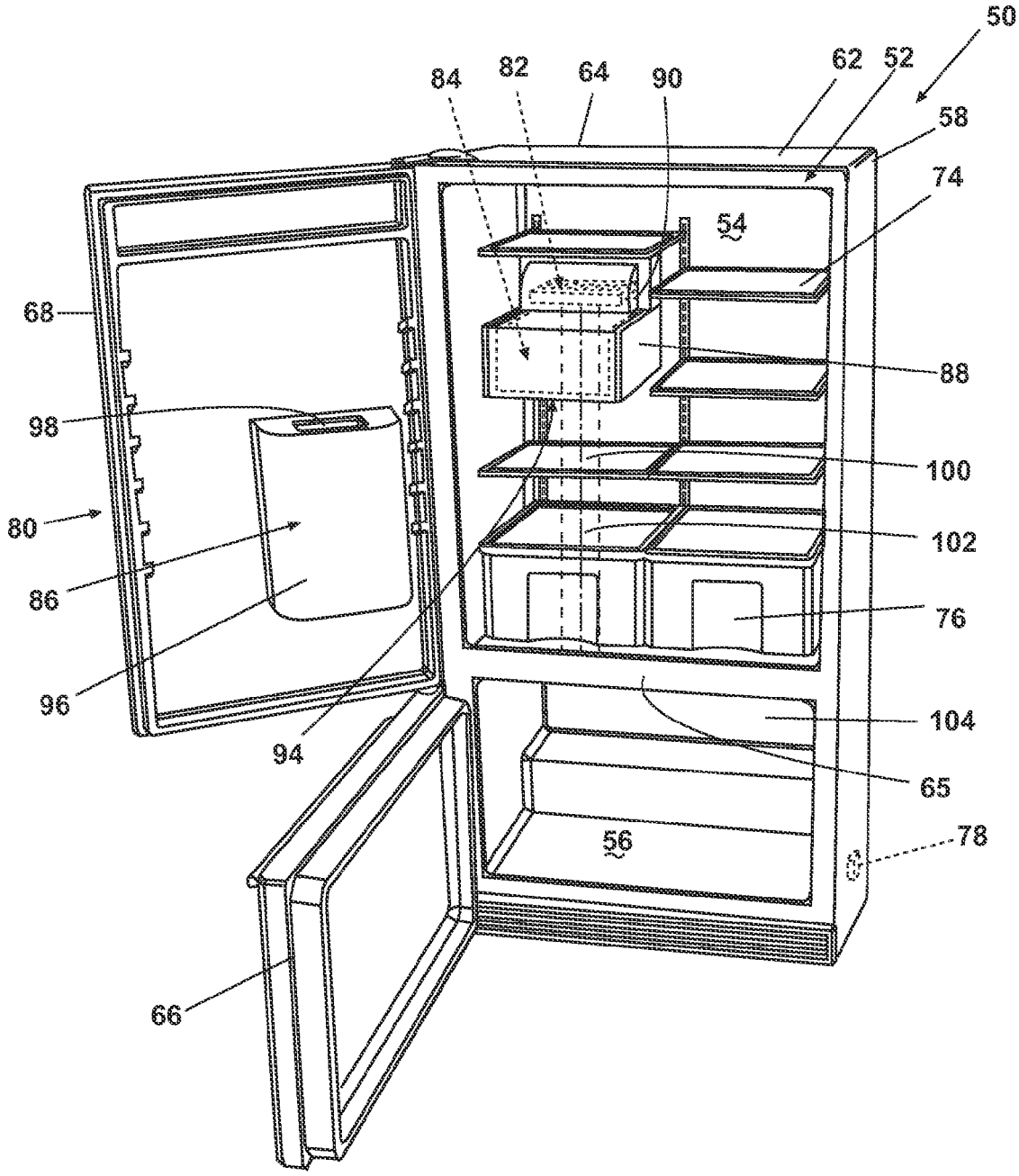
FIG. 2 is a perspective view of the interior of the refrigerator illustrated in FIG. 1 illustrating a first embodiment of a refrigerator-mounted ice cube forming and dispensing apparatus.

FIGS. 1 and 2 illustrate a bottom freezer refrigerator 50 comprising an embodiment of an ice-making and dispensing apparatus according to the invention. The refrigerator 50 comprises a generally well-known insulated cabinet 52 defining an upper refrigerator compartment 54 and a lower freezer compartment 56 located beneath the refrigerator compartment 54. Refrigerator compartment 54 can be arranged to maintain temperatures above 0° C., while freezer compartment 56 can be arranged to maintain temperatures below 0° C. The cabinet 52 comprises a pair of insulated sidewalls 58, 60, an insulated top wall 62, and an insulated back wall 64. A compartment separator 65 can bisect the interior of the cabinet 52 and separate the refrigerator compartment 54 from the freezer compartment 56.

An insulated freezer compartment door 66 is hingedly mounted to the cabinet 52 to provide selective access to the freezer compartment 56. Similarly, an insulated refrigerator compartment door 68 is hingedly mounted to the cabinet 52 to provide selective access to the refrigerator compartment 54. While the freezer compartment door 66 is illustrated as being hingedly mounted about a vertical axis, it could also be configured as a horizontally translating pullout freezer drawer.

The refrigerator 50 also comprises shelves 74 and storage bins 76, which are illustrated in FIG. 2 in the refrigerator compartment 54, but which can also be located in the freezer compartment 56. The refrigerator 50 can also comprise a traditional cooling system comprising a motor driven compressor and evaporator containing a suitable coolant, one or more ventilation fans, appropriate thermostatic controls for maintaining the refrigerator compartment 54 and the freezer compartment 56 at selected temperatures, and other well-known functional features (not shown), which are not germane to the inventive concepts and will not be further described herein, except as necessary for a complete understanding of the inventive concepts.

An ice and water dispensing outlet 72 can be installed in a refrigerator compartment door 68 for delivering ice and water through the refrigerator compartment door 68. The dispensing outlet 72 can be similar in many respects to an ice and water dispensing outlet disclosed in U.S. Pat. No. 6,050,097 to Nelson et al. (hereinafter referred to as "the Nelson et al. '097 patent"), which is incorporated herein in its entirety, and which is adapted to selectively deliver whole or crushed ice cubes and/or water in response to activation of a selection control device (not shown) incorporated into the dispensing outlet 72.

An embodiment of an insulated ice maker module 80 according to the invention incorporated into refrigerator 50 is illustrated in FIG. 2. The ice maker module 80 can comprise an automatic ice maker 82 having similar features to an automatic ice maker disclosed in the Nelson et al. '097 patent. The ice maker 82 can be mounted in the refrigerator compartment 54 in a generally well-known manner to one or more of the top wall 62, a side wall 60, the back wall 64, and/or the underside of a shelf 74. Ice maker 82 can be provided with a water supply by water valve 78 as is well known in the art. An ice cube storage bin 84 can be positioned beneath the ice maker 82 and adapted to hold ice cubes formed by the ice maker 82 and delivered to the ice cube storage bin 84 through an ice cube outlet 90. The ice cube storage bin 84 can be adapted for removal from the refrigerator compartment 54 for bulk retrieval of ice cubes. Both the ice maker 82 and the ice cube storage bin 84 can be enclosed within an insulated housing or enclosure 88 capable of maintaining the temperature of the ice maker 82 and the ice cube storage bin 84 at a selected below 0° C. temperature sufficient for the formation and storage of the ice cubes, and to prevent the flow of below 0° C. air to the refrigerator compartment 54. Those skilled in the art will understand that enclosure 88 can be permanently or slideably mounted in refrigerator compartment 54, and if slideably mounted can be provided with suitable flexible/extendable water and electrical connections. Ice cube storage bin 84 can be arranged as a drawer slideably positioned in refrigerator compartment 54 or can be slideably positioned in enclosure 88. The ice cube storage bin 84 can be provided with ice cube storage bin outlet 94 adapted for delivery of ice cubes to a dispenser 86.

Figure 6:
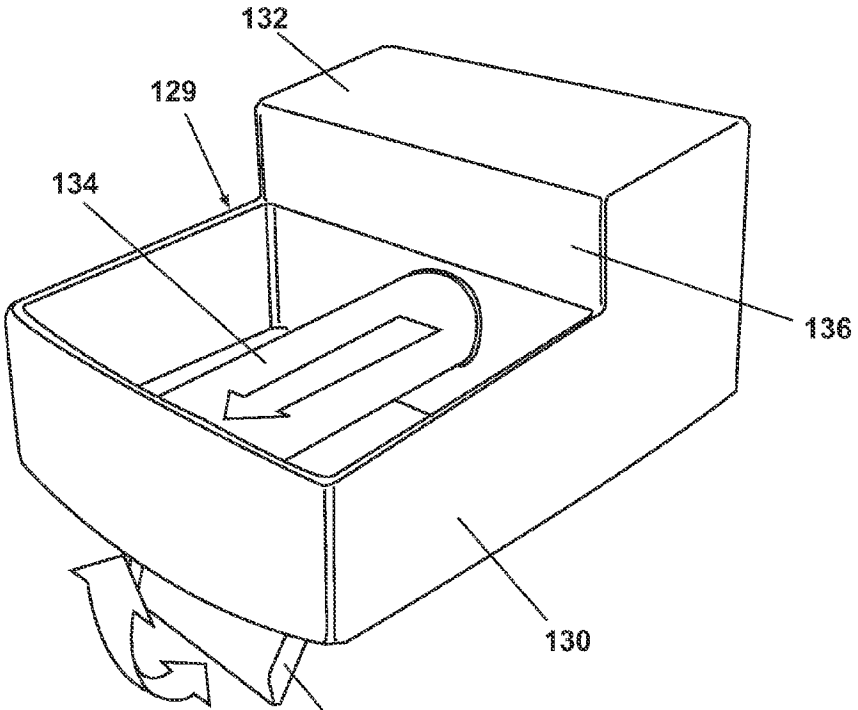
FIG. 6 is a partial perspective view of one embodiment of an ice making and dispensing apparatus that can be used in the embodiment shown in FIG. 2.
Figure 7:
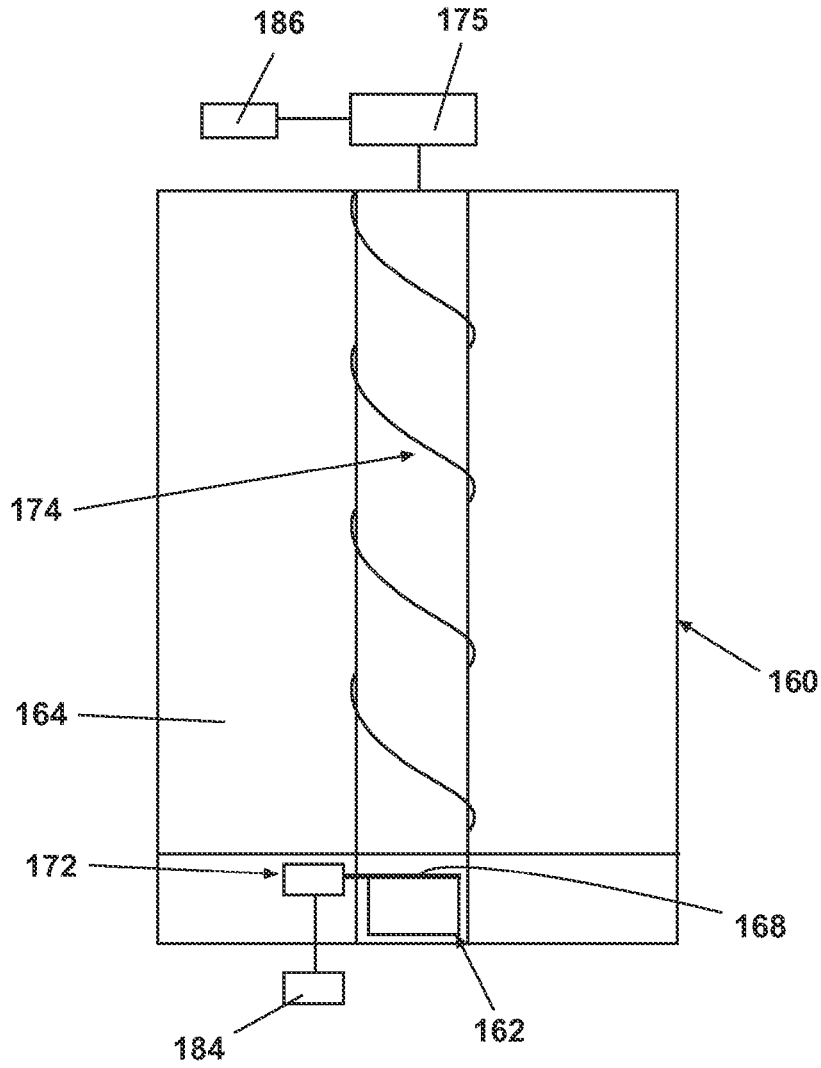
FIG. 7 is a schematic top view of another embodiment of ice cube storage bin that can be used in the embodiment shown in FIG. 2.

The dispenser 86 can be located in housing or enclosure 96 mounted to an inner surface of the refrigerator compartment door 68 and can have similar features to an ice cube dispenser disclosed in the Nelson et al. '097 patent and can be operably connected to the dispensing outlet 72. Enclosure 96 can be insulated, if desired, but those skilled in the art will understand that the dispenser mechanism need not be maintained at below 0° C. temperatures. The dispenser 86 can be provided with a dispenser inlet 98 which can be adapted for cooperative register with the ice cube storage bin outlet 94 to receive ice cubes from the storage compartment outlet 94 in response to activation of the selection control device in the dispensing outlet 72. The ice cube storage bin outlet 94 can be provided with a suitable movable flap or door as shown in FIGS. 6–7, described below, that can be designed to allow the passage of ice cubes therethrough but minimize the flow of low-temperature air from the ice cube storage bin 84 to the refrigerator compartment 54 and to the dispenser 86 when the flap is in a closed position. Those skilled in the art will understand that, in lieu of a movable flap or door, a suitable gasket can be provided to minimize the flow of below 0° C. air into the refrigerator compartment 54.

In operation, ice maker 82 can form and deliver ice cubes to the ice cube storage bin 84. A suitable well-known control device (not shown) can be employed to control the production of the ice cubes and avoid overflow from the ice cube storage bin 84. The ice cubes can be held in the ice cube storage bin 84 until activation of the selection control device in the dispensing outlet 72. When dispenser 86 is activated a quantity of ice cubes can be delivered from the ice cube storage bin 84 to the dispenser 86 and through the dispenser 86 to dispensing outlet 72. Operation of dispenser 86 to dispense ice cubes through dispensing outlet 72 can be similar to operation of the ice dispenser described in the Nelson et al. '097 patent referenced above.

The ice maker 82 and the ice cube storage bin 84 can be chilled by the delivery of air from an evaporator compartment 104 enclosing the refrigerator evaporator 41 (FIG. 2A) to the insulated enclosure 88. The below 0° C. air can be provided to insulated housing 88 through supply and return air ducts 100, 102 formed in the cabinet 52 and fluidly coupled to the evaporator compartment 104. Those skilled in the art will understand that supply air duct 100 and return air duct 102 can be located in the insulation space between the refrigerator compartment and the cabinet 52, or can be located in refrigerator compartment 54 along the rear or side walls. In addition, those skilled in the art will understand that the source of below 0° C. air can be the freezer compartment 56 instead of the evaporator compartment 104. The insulated enclosure 88 can be controlled as a separate freezer compartment by supplying a preselected flow of below 0° C. air to the enclosure 88 while the compressor serving the refrigerator 50 is operating. Alternatively, a thermostat or thermistor control (not shown) can be utilized to control the air flow to the enclosure 88. In yet another alternative, all or a portion of the below 0° C. air for chilling the refrigerator compartment 54 can be first routed to the enclosure 88, then exhausted into the refrigerator compartment 54, in proportions sufficient to provide the desired temperatures to the enclosure 88 and the refrigerator compartment 54.

Figure 2A:
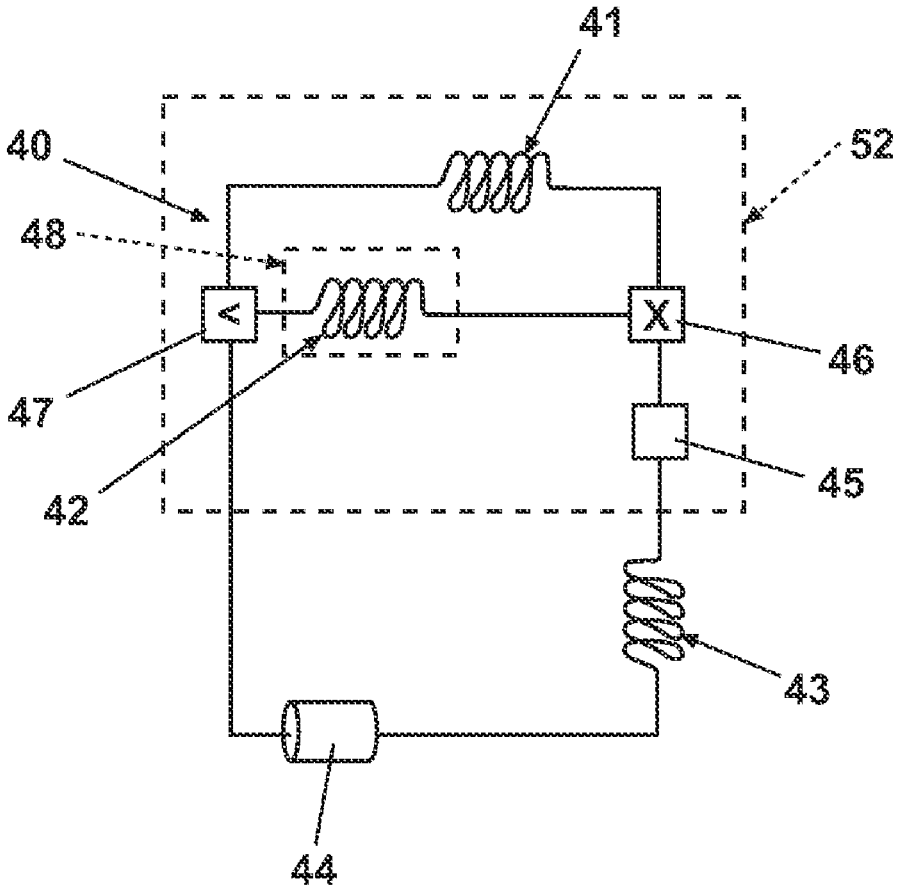
FIG. 2A is a schematic representation of a dedicated evaporator system that can be used with the ice cube forming and dispensing apparatus illustrated in FIG. 2.

Alternatively, a dedicated evaporator system 40 comprising an ice maker evaporator 42 can be used to chill the insulated enclosure 88, as illustrated in FIG. 2A. The ice maker evaporator 42 can be placed in parallel (shown) or in series with the main refrigerator evaporator 41 to provide cooling of the insulated enclosure 88, the ice maker 82, and the ice cube storage bin 84. The ice maker evaporator 42 can be fluidly connected to the main refrigerator compressor 44 and condenser coil 43, and can be used to chill air delivered to the enclosure 88 or can be incorporated into or placed in direct contact with ice maker 82. Refrigerant lines can be run from the main compressor/evaporator system through the cabinet walls 58–64 and enclosed within the insulation in the walls. Suitable controls, such as a microprocessor-controlled expansion valve 45, a diverting valves 46, a check valve 47, a thermostat(s), and the like, can be used to regulate flow of refrigerant to the ice maker evaporator 42 in order to provide appropriate control of the temperature of the enclosure 88.

A well-known water supply (not shown) that can include a water valve 78 can be integrated into the dispensing outlet 72 so that, in addition to ice cubes, water, or a combination of both ice cubes and water can be selectively provided to a user. Suitable flexible connectors can be provided to accommodate the movement of the door 68 between the open and closed positions. Similarly, a suitable flexible connector would be required for water lines serving both the ice maker and water dispenser. The dispensing outlet 72 can include water dispensing similar to an ice and water dispensing outlet disclosed in co-pending U.S. patent application Ser. No. 10/861,203 filed by Voglewede et al. ("Voglewede et al. '203"), which is incorporated herein in its entirety. Voglewede et al. '203 discloses a water dispenser which is adapted to selectively deliver selected quantities of chilled water in response to activation of a control device (not shown) incorporated into the dispensing outlet 72. Water valve 78 can be connected to ice maker 82 to provide water for forming ice cubes as is well known in the art.

Figure 3:
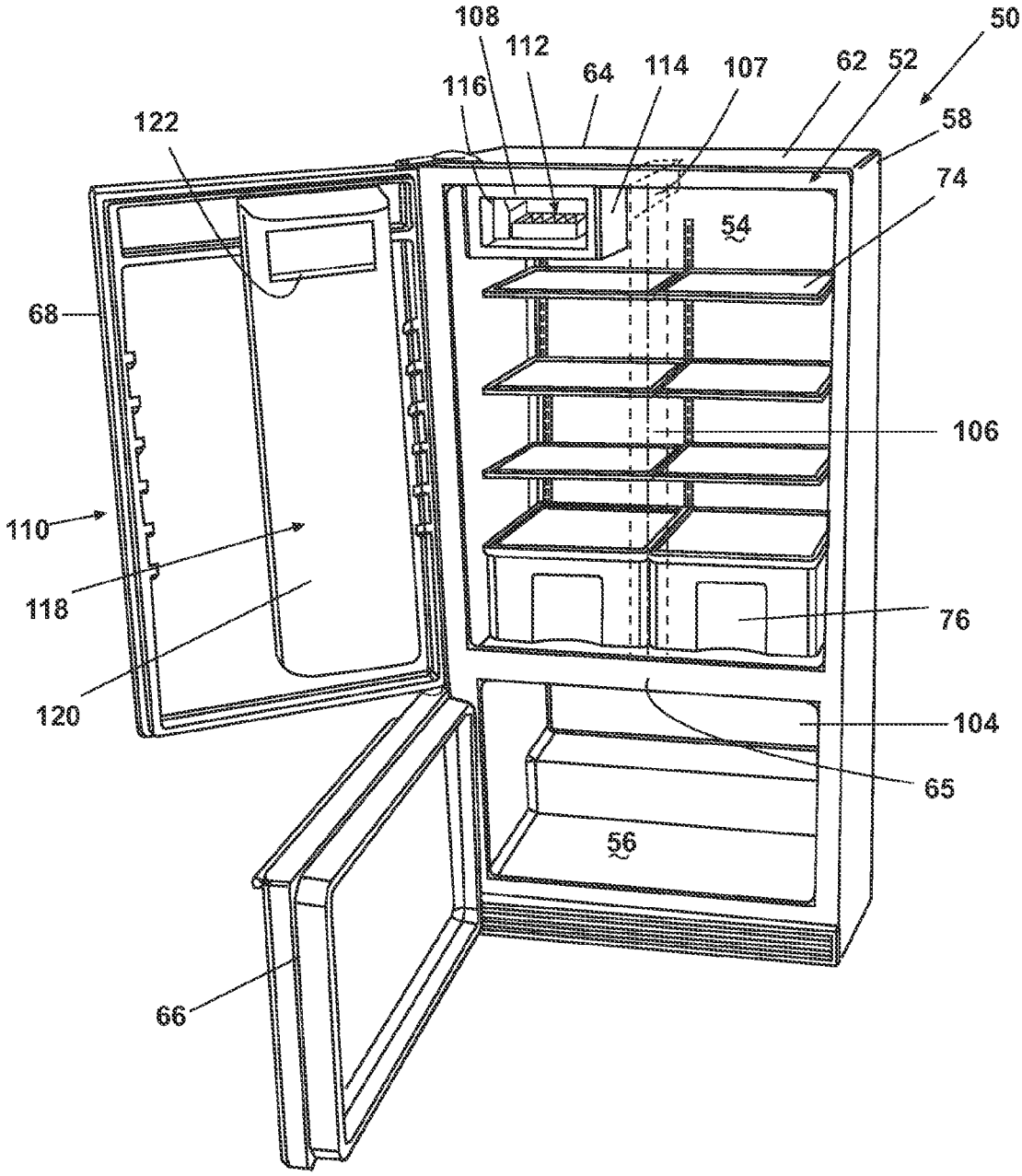
FIG. 3 is a perspective view of the interior of the refrigerator illustrated in FIG. 1 illustrating another embodiment of a refrigerator-mounted ice cube forming and dispensing apparatus according to the invention.
Figure 3A:
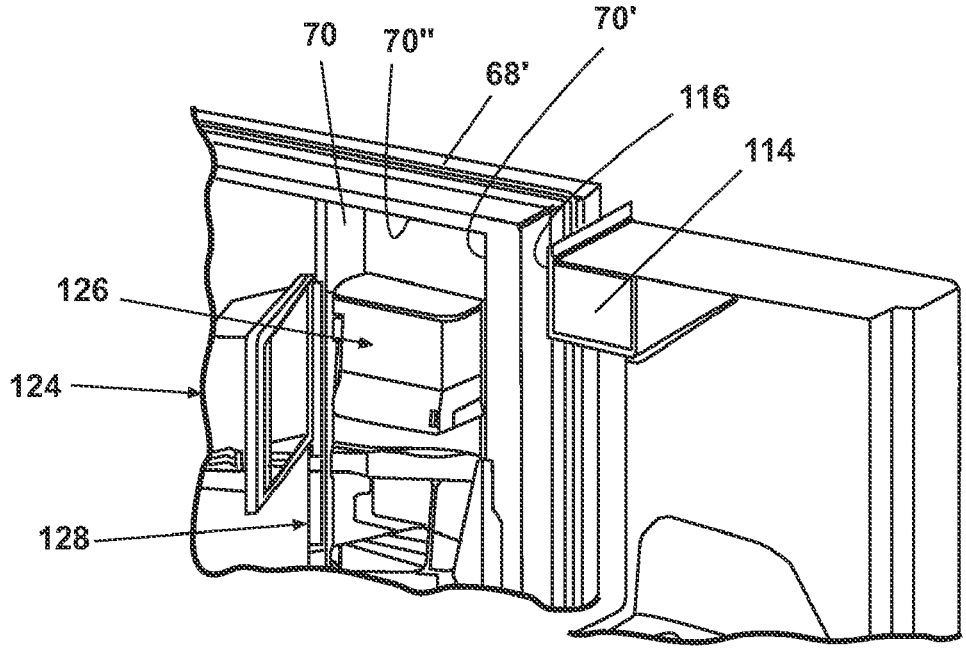
FIG. 3A is a partial perspective view illustrating another embodiment of an ice cube storage bin and dispenser for use with the ice cube forming an dispensing embodiment of FIG. 3.
Figure 3B:
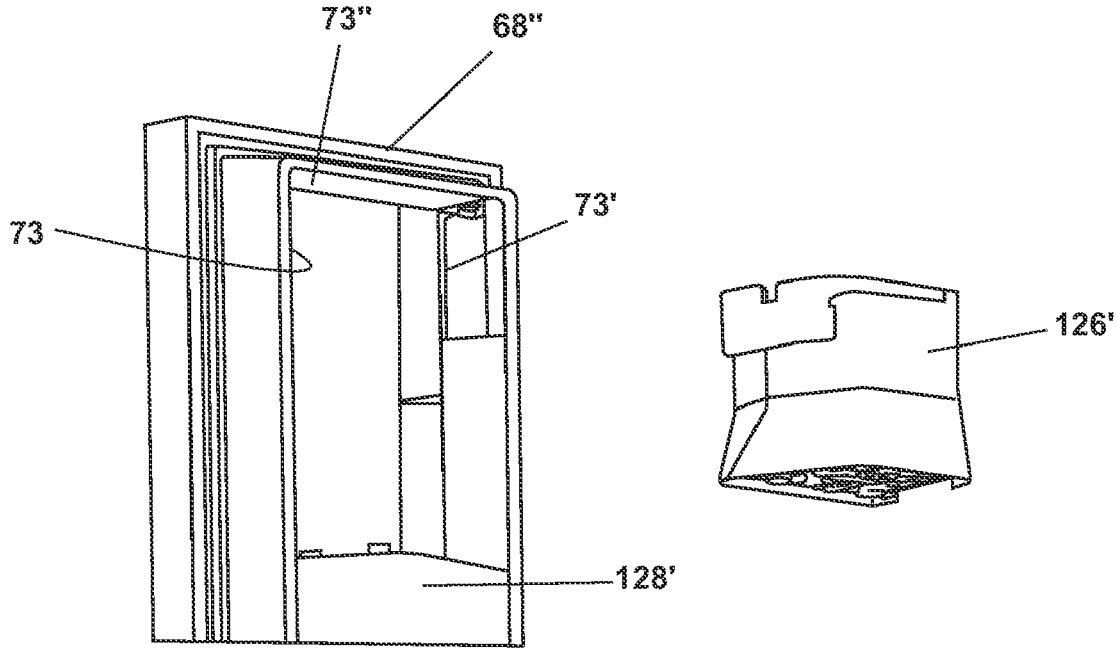
FIG. 3B is a partial exploded view illustrating another embodiment of an ice cube storage bin and dispenser for use with the ice cube forming and dispensing embodiment of FIG. 3.

Referring now to FIGS. 3, 3A and 3B an alternate embodiment of an ice-making/dispensing apparatus 110 is illustrated, which is similar to many respects to the embodiment illustrated in FIGS. 1 and 2. In this embodiment, an ice maker 112 can be mounted in the refrigerator compartment 54 in a well-known manner to one of the walls of the refrigerator compartment and/or the underside of a shelf 74. In FIG. 3 ice maker 112 can be seen mounted to the top wall of the refrigerator compartment 54. The ice maker 112 can be enclosed within an insulated sub-compartment or insulated enclosure 114 and can be provided with an ice maker outlet 116 through which ice cubes are delivered. A combination ice cube storage bin and dispenser 118 can comprise an insulated enclosure 120 which can be mounted to an inner surface of the refrigerator compartment door 68 and can have similar features to the through-the-door dispenser disclosed in the Nelson et al. '097 patent. An ice cube storage bin (not shown) and an ice cube dispenser (not shown) can be positioned on refrigerator door enclosed by insulated enclosure 120. The enclosure 120 can be provided with a dispenser inlet 122 which can be adapted for cooperative register with the ice maker outlet 116 to receive ice cubes from the ice maker 112. The combination ice cube storage bin and dispenser can also be similar to the ice cube storage bin and dispenser embodiments disclosed in co-pending U.S. Patent Application US20040111 filed by Anselmino et al concurrently with this application and is incorporated herein in its entirety. Thus, in this embodiment, the ice cube storage bin can be mounted to the door 68 rather than attached to the ice maker 112.

Ice can be delivered from the ice maker 112 through the ice maker outlet 116 and the dispenser inlet 122 into the ice cube storage bin. A gasket 108 can be provided on the face of insulated enclosure 114 around ice maker outlet 116 to seal the inlet 122 to the outlet 116 when the door 68 is closed. Insulated enclosure 114 and enclosure 120 create a module comprising an insulated compartment enclosing the ice maker 112, and the combination ice cube storage bin and dispenser 118.

Turning to FIG. 3A, another embodiment of ice cube storage bin and dispenser can be seen on refrigerator door 68'. The embodiment of FIG. 3A includes an insulated cover 124 that can be hingedly mounted to refrigerator door 68' to form an insulated space for an ice cube storage bin 126. Insulated cover 124 and ice cube storage bin 126 can be similar to the ice cube storage bin and dispenser disclosed in FIG. 4 in co-pending U.S. Patent Application US20040111 filed by Anselmino et al. concurrently with this application which is incorporated herein in its entirety. Ice cube storage bin 126 can receive ice cubes from an ice maker, not shown, positioned in insulated ice maker module 114 similar to the embodiment of FIG. 3. The space above ice cube storage bin 126 can be enclosed by walls 70, 70' and 70" that can be formed in the door liner of door 68'. The space above ice cube storage bin 126 can be arranged to be closed by the front wall of ice maker module 114 as shown in FIG. 3. A gasket (not shown) similar to gasket 108 in FIG. 3 can be arranged around ice maker outlet 116 to seal the ice maker enclosure 114 to the insulated cover 124 and walls 70, 70' and 70" when refrigerator door 68' is closed. An ice dispenser 128 can be positioned below ice cube storage bin 126 for dispensing ice cubes as described above. Those skilled in the art will understand that ice cube storage bin 126 can be removable for bulk dispensing of ice cubes such as into a cooler and the like.

Turning to FIG. 3B, another embodiment of ice cube storage bin can be seen. Refrigerator door 68" can include an insulated ice cube storage bin 126' that can include double walls to insulate ice cubes stored in the bin from the above 0° C. temperatures in the refrigerator compartment 54. Ice cube storage bin 126' can be positioned on ice dispenser 128' and can operate in a manner similar to the ice cube storage bin and dispenser described in FIG. 6 of U.S. patent application Ser. No. 20040111 filed by Anselmino et al and incorporated herein in its entirety. Refrigerator compartment door 68" can include walls 73, 73' and 73" that can form an enclosed space above ice cube storage bin 126' when the refrigerator compartment door 68" is closed and walls 73, 73' and 73" contact the face of insulated ice maker module 114 as described above. When refrigerator compartment door 68" is closed the open top of ice cube storage bin 126' can be positioned in front of and under ice maker module 114, not shown in FIG. 3B, to substantially close ice cube storage bin 126' from the refrigerator compartment 54. When refrigerator door 68" is closed ice cubes harvested from the ice maker, not shown in FIG. 3B, can fall into the ice cube storage bin 126'. Ice cube storage bin 126' can be arranged for removal from refrigerator door 68" for bulk dispensing of ice cubes such as into a cooler.

In operation, ice cubes from the ice maker 112 can be formed and delivered to the combination ice cube storage bin and dispenser 118 while the door 68 is closed. Similarly, ice cubes can be formed and delivered to the ice cube storage bins 126 and 126' in the embodiments of FIG. 3A and FIG. 3B. A suitable control device, similar the control device in the through-the-door dispenser disclosed in the Nelson et al. '097 patent, can be employed to control the production of the ice cubes and avoid overflow of the ice cube storage bins. As well, a control device can be employed on the ice maker 112 to control the delivery of ice cubes through the ice maker outlet 116 when the door 68 is open. The ice cubes can be held in the door-mounted ice cube storage bin until activation of the selection control device in the dispensing outlet 72, at which time a quantity of ice cubes can be delivered from the ice cube storage bin through the dispensing outlet 72. The insulated enclosure 120, insulated cover 124 and insulated ice cube storage bin 126' can be arranged to maintain the proper temperature in the ice cube storage bin for storage of the ice cubes.

The ice maker 112 and the ice cube storage bin can be chilled by the delivery of air from an evaporator compartment 104 of the refrigeration system to the insulated enclosure 114 or can be chilled by a dedicated evaporator system 40 as previously described. As previously described, below 0° C. air can be provided through supply and return air ducts 106, 107 that can be located in refrigerator compartment 54 or formed in the cabinet 52 and fluidly coupled to the evaporator compartment. Those skilled in the art will understand that air ducts 106 and 107 can be arranged to form supply and return air passages. Those skilled in the art will understand that supply and return air ducts can be located in the insulation space between the refrigerator compartment and the cabinet 52, or can be located in refrigerator compartment 54 along the rear or side walls. Below 0° C. air can be provided to enclosure 120 from insulated ice maker enclosure 114 through ice maker outlet 116 and dispenser inlet 122. Similarly, below 0° C. air can be provided to the ice cube storage bin 126 and insulated ice cube storage bin 126' through the ice maker outlet, not shown, and the open top of ice cube storage bins 126 and 126'. Those skilled in the art will understand that alternate sources for below 0° C. air for insulated enclosure 120, ice cube storage bin 126 and insulated ice cube storage bin 126' can be provided. Additionally, a water supply (not shown) including water valve 78 can be integrated into the dispensing outlet 72 for selective delivery of water, or a combination of both ice cubes and water can be delivered as described above in connection with FIGS. 1 and 2. The water supply can also provide water to the ice maker 112 as described above in connection with FIGS. 1 and 2. Those skilled in the art will understand that the ice cube storage bin, not shown, in FIG. 3 can be arranged for removal for bulk dispensing in a manner similar to the embodiments of FIGS. 3A and 3B.

Figure 4:
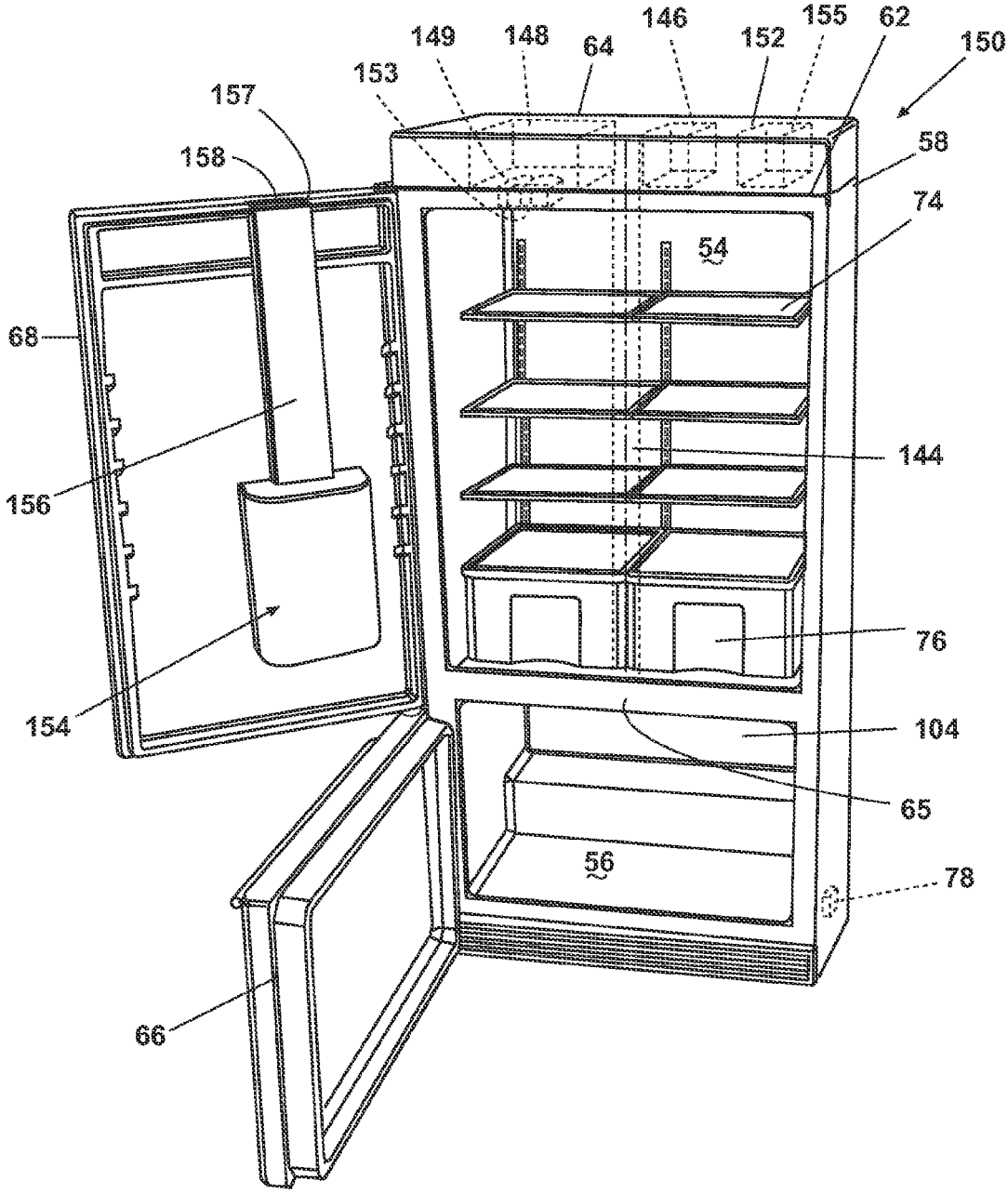
FIG. 4 is a perspective view similar to FIGS. 1–3 of another embodiment of a refrigerator-mounted ice cube forming and dispensing apparatus.
Figure 4A:
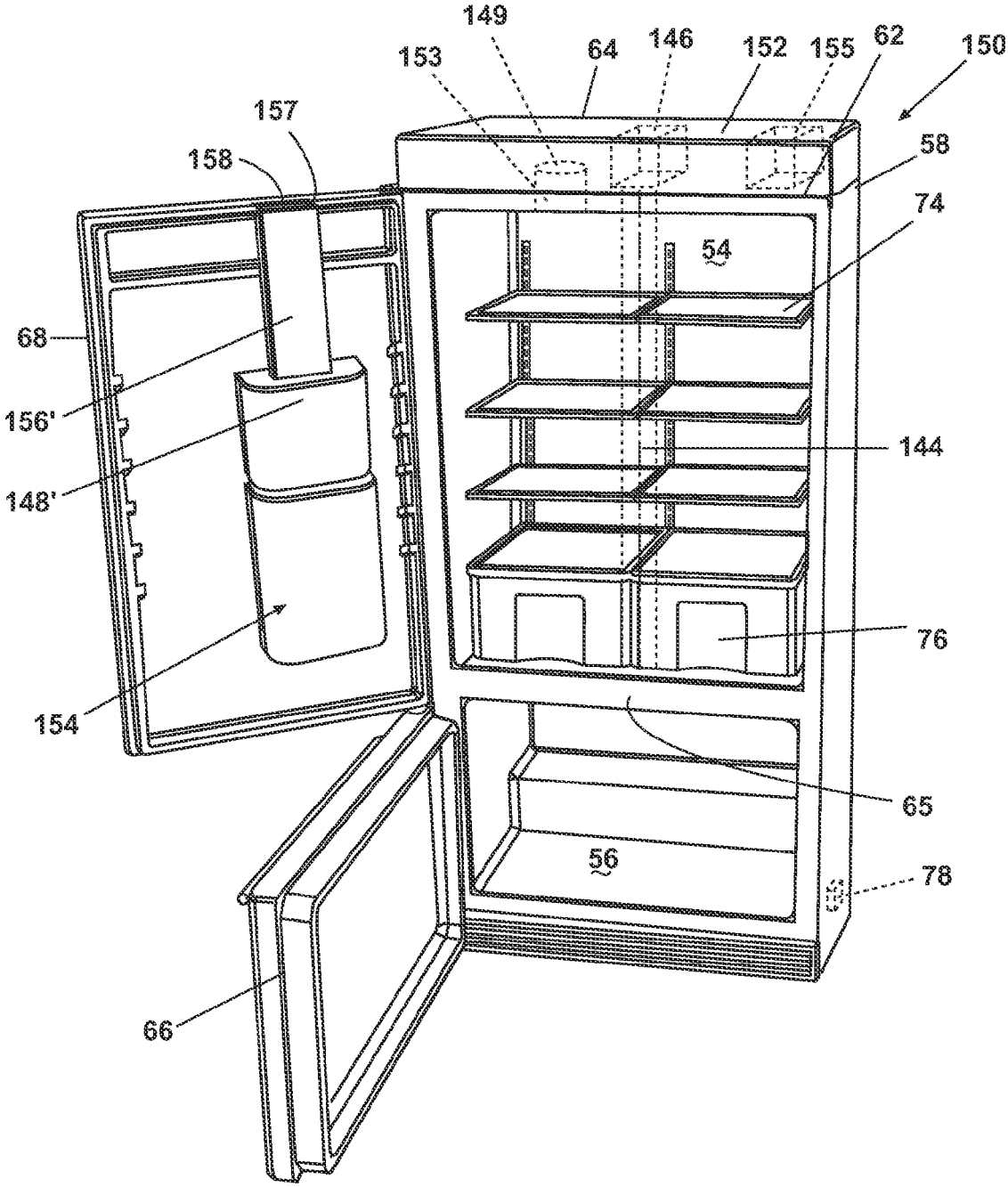
FIG. 4A is a perspective view similar to FIG. 4 illustrating another embodiment of a refrigerator-mounted ice cube forming and dispensing apparatus.
Figure 6B:
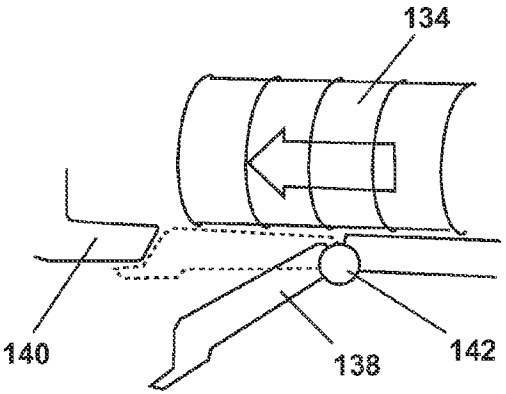
FIG. 6B is a partial section view of the ice storage bin of FIG. 6A showing the movable door mounting.
Figure 6A:
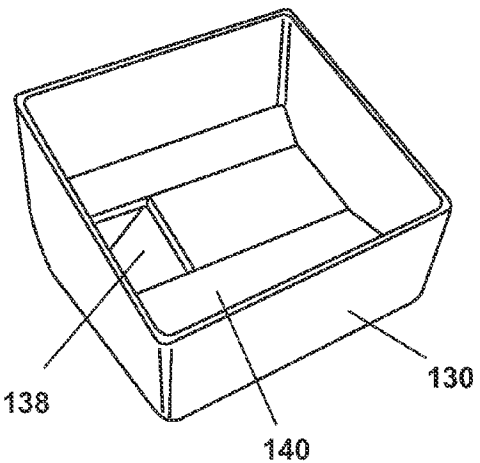
FIG. 6A is a partial perspective view of the ice storage bin of the ice making and dispensing apparatus shown in FIG. 6.

FIG. 4 illustrates an embodiment of an ice making and dispensing apparatus 150 comprising an insulated ice maker module 152 mounted to the exterior of the refrigerator cabinet. Insulated module 152 can also be considered an insulated sub-compartment mounted on the exterior of the refrigerator cabinet. The insulated module 152 illustrated in FIG. 4 can be mounted to the top wall 62. However, the insulated module 152 can also be arranged to be mounted to a side wall 58, 60 or the back wall 64. The insulated module 152 can comprise an ice maker 146 for forming ice cubes and an ice cube storage bin 148 for holding ice cubes prepared by the ice maker. A well-known ice transporting device, such as an auger (not shown), can be used to transport ice cubes stored in the ice cube storage bin 148 to an outlet 149 provided in the module 152 for delivering ice by gravity feed to the dispensing outlet 72 in the door 68. Ice cube storage bin 148 can be similar to the ice cube storage bin described in connection with FIGS. 6A to 6C. As illustrated in FIG. 4, a passage 156 can be attached to an inner surface of the door 68 having a dispenser inlet 158 at an upper end thereof for receiving ice cubes from outlet 149 in the insulated module 152. Passage 156 can be an insulated, however, those skilled in the art will understand that passage 156 need not be insulated unless ice cubes are stored in the passage in operation. The dispenser inlet 158 can be adapted for cooperative register with the module outlet (not shown) when the door 68 is closed. Those skilled in the art will understand that a suitable passage 153 can be provided in the top wall 62 of the cabinet to allow ice cubes to flow from outlet 149 in insulated module 152 into passage 156. A gasket assembly 157 between the dispenser inlet 158 and the passage 153 can be used to seal the inlet 158 to passage 153 when the door 68 is closed, thereby preventing the flow of chilled air from the insulated module 152 to the refrigerator compartment 54. Those skilled in the art will understand that gasket assembly 157 can also be mounted to passage 153 to engage dispenser inlet 158 when refrigerator door 68 is closed. Alternately, the module outlet 149 can be provided with a suitable door (not shown) similar to the movable door described below in the embodiment illustrated in FIG. 6 to prevent flow of chilled air out of module 152 when ice is not being dispensed. Passage 156 can discharge ice cubes into dispenser 154. Insulated module 152 can also include a chilled water reservoir 155 that can be connected to the dispenser on the face of refrigerator door 68 in order to provide ice and water dispensing. Those skilled in the art will understand that chilled water reservoir 155 can be connected to door 68 through a door hinge or other known arrangements. Those skilled in the art will understand that dispenser 154 can be similar to the dispensers in the embodiments of FIGS. 2 and 3. Those skilled in the art will also understand that the ice cube storage bin 148' can be mounted on the refrigerator compartment door as shown in FIG. 4A similar to the embodiments of FIGS. 3, 3A and 3B. In the embodiment of FIG. 4A ice cube storage bin 148' can be insulated and, with insulated passage 156', can comprise a lower module portion connected to upper module portion 152 when door 68 is closed. In the event ice cube storage bin 148' is mounted on the refrigerator door a suitable source of below 0° C. air can be provided to maintain the stored ice cubes at below 0° C. temperatures as described in connection with FIGS. 3, 3A and 3B.

In operation, ice cubes from ice maker 146 can be delivered to the ice cube storage bin 148 as is well known in the art. As described above, a suitable well-known control device can be employed to control the production of the ice cubes and avoid overproduction. The ice cubes can be held in the ice cube storage bin 148 until activation of the selection control device in the dispensing outlet 72. When the dispenser is activated, ice cubes can be delivered from the ice cube storage bin 148 in insulated module 152, through passage 156 to dispenser 154 and out the dispensing outlet 72. As indicated above, the ice cube storage bin 148 can include an auger (see FIGS. 6 and 6B) or other mover to move ice cubes to outlet 149 in insulated module 152 so that the ice cubes can fall through passage 156 to the dispenser 154. Similarly, when ice cube storage bin 148' is positioned on refrigerator door 68 as illustrated in FIG. 4A ice cubes harvested from ice maker 146 can be delivered to the ice cube storage bin 148' through passage 156'. As in the embodiments of FIGS. 3, 3A and 3B ice cubes can be delivered from ice cube storage bin 148' to dispenser 154 when a user activates ice dispensing as is well known in the art.

The ice maker module 152 can be chilled by the delivery of air from an evaporator compartment 104 of the refrigeration system to the insulated sub-compartment 152 or can be chilled by a dedicated evaporator system 40 as previously described. As previously described, below 0° C. air can be provided through supply and return air ducts 144 formed in the cabinet 52 and fluidly coupled to the evaporator compartment. Those skilled in the art will understand that supply and return air ducts 144 can be located in the insulation space between the refrigerator compartment and the cabinet 52, or can be located in refrigerator compartment 54 along the rear or side walls. Below 0° C. air can be provided to passage 156' from insulated ice maker module 152 through inlet 158 in the event ice cube storage bin 148' is positioned on refrigerator door 68. Those skilled in the art will understand that alternate sources for below 0° C. air for insulated ice maker module can be provided including but not limited to an auxiliary or ice maker evaporator as described in connection with FIG. 2A. Additionally, a water can be provided to the ice maker module 152 by water valve 78 as described above in connection with FIGS. 1 and 2. Chilled water reservoir 155 can be arranged in insulated ice maker module 152 to be cooled by in connection with cooling the ice maker 146 and ice cube storage bin 148 (in the FIG. 4 embodiment). Those skilled in the art will understand that chilled water reservoir can be arranged to be cooled to temperatures above 0° C. to avoid freezing water stored in the reservoir.

Figure 5:
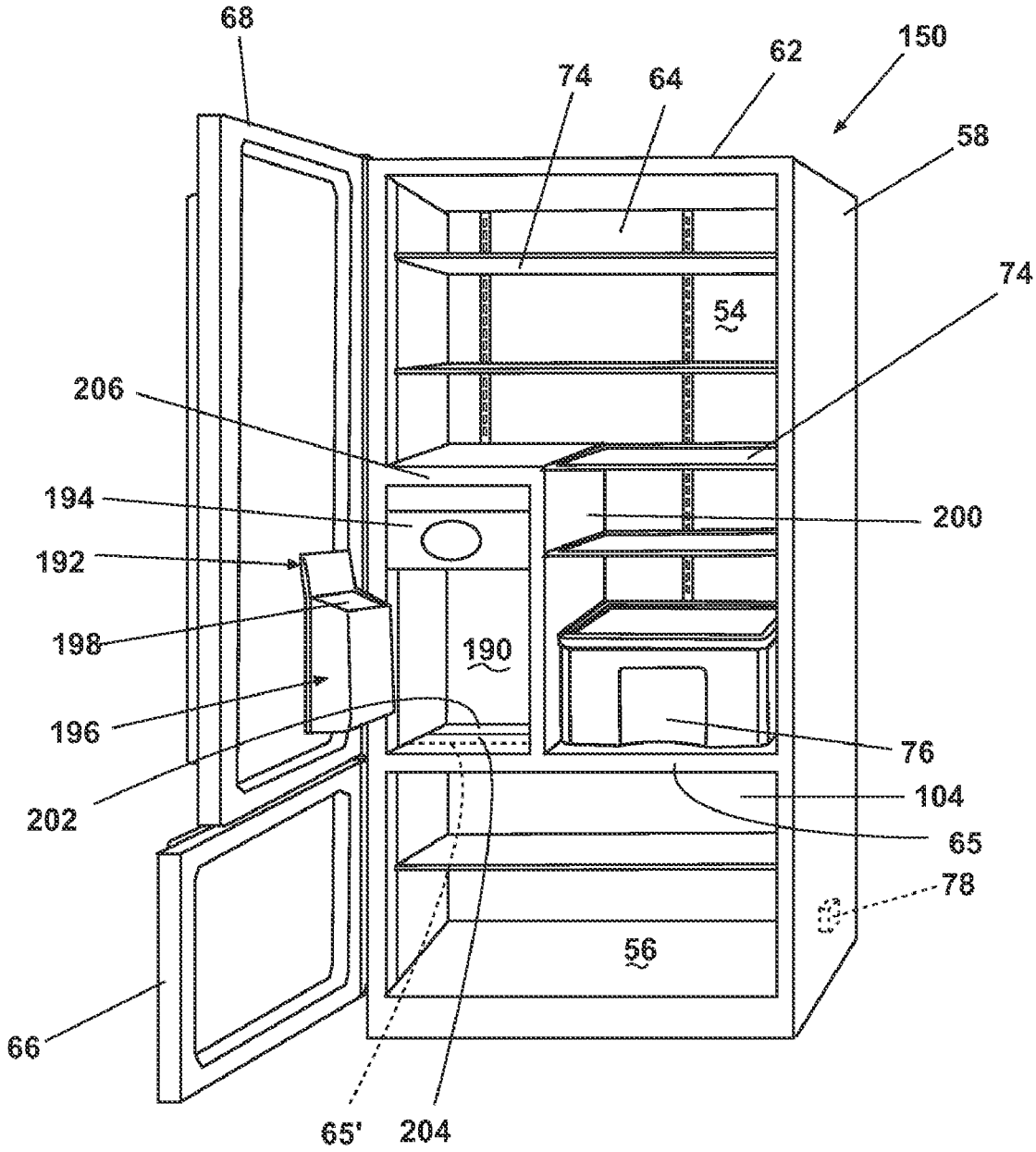
FIG. 5 is a perspective view of the interior of a bottom freezer refrigerator illustrating another embodiment of an ice cube forming and dispensing apparatus.

FIG. 5 illustrates an embodiment in which the freezer compartment 56 can include an auxiliary freezer compartment or insulated sub-compartment 190 which extends partly into the refrigerator compartment 54. The auxiliary freezer compartment 190 is adapted to hold an ice making and dispensing apparatus 192. The ice maker and ice cube storage bin 194 can be similar to the ice maker and ice cube storage bin described above in the embodiment of FIG. 2. Those skilled in the art will understand that ice maker and ice cube storage bin 194 can also be also be a conventional side by side refrigerator ice maker and ice cube storage bin. The auxiliary freezer compartment 190 can be closed by the refrigerator compartment door 68 and can be provided with perimeter seals or gaskets 206 adapted for cooperative register with the door 68 to prevent the flow of air from the auxiliary freezer compartment 190 into the refrigerator compartment 54 when the door 68 is closed. Those skilled in the art will understand that gaskets 206 can be located on door 68 if desired to register with the face of compartment separator 65, dividing wall 200, bottom wall 65' and cabinet 52 surrounding auxiliary freezer compartment 190. A door-mounted dispenser 196 can be adapted for receipt of ice cubes through dispenser inlet 198 and dispensing of ice cubes from the ice maker and ice cube storage bin 194 as found in a conventional side-by-side refrigerator having through-the-door ice cube dispensing. Those skilled in the art will understand that the dispenser 196 can alternately be a combination ice cube storage bin and dispenser as disclosed in the Nelson et al. '097 patent and ice maker 194 can be an ice maker as disclosed in the Nelson et al. '097 patent.

The auxiliary freezer compartment 190 can be open to the freezer compartment 56, or a bottom wall 65' can comprise a portion of compartment separator 65 separating the freezer compartment 56 from the refrigerator compartment 54. In the latter configuration, chilled air can be routed from the freezer compartment 56 to the auxiliary freezer compartment 190 through a passage 202 formed in bottom wall 65'. Bottom wall 65' can be used to store items in the auxiliary freezer compartment 190 in the space below dispenser 196. Passage 202 can be a gap between bottom wall 65' and back wall 64. Those skilled in the art will understand that in lieu of gap, passage 202 can be one or more passages formed in bottom wall 65'. Passage 202 can be provided with a slidable damper 204 that can be manually or thermostatically controlled to permit independent control of temperatures in the auxiliary freezer compartment 190 and freezer compartment 56. Damper 204 is schematically shown as a sliding damper. Those skilled in the art with understand that damper 204 can be pivotal or rotatable instead of slidable if desired. The auxiliary freezer compartment 190 can be insulated and sealed to prevent the migration of chilled air into the refrigerator compartment 54. Those skilled in the art will understand that auxiliary freezer compartment 190 can be isolated from freezer compartment 56 by dividing wall 200, wall 65' and compartment separator 65. Those skilled in the art will understand that auxiliary freezer compartment 190 can have below 0° C. air routed to auxiliary freezer compartment 190 from the evaporator compartment 104 as described above. Those skilled in the art will also understand that an ice maker evaporator similar to that described above in conjunction with FIG. 2A can be provided in auxiliary freezer 190 to maintain below 0° C. temperatures for forming and storing ice cubes. Also as described above, an ice maker evaporator can be located in auxiliary freezer compartment 190 or can be mounted to the ice maker mold (not shown). Ice maker and ice storage bin 194 can be supplied with water by water valve 78 as is well known by those skilled in the art.

Figure 6C:
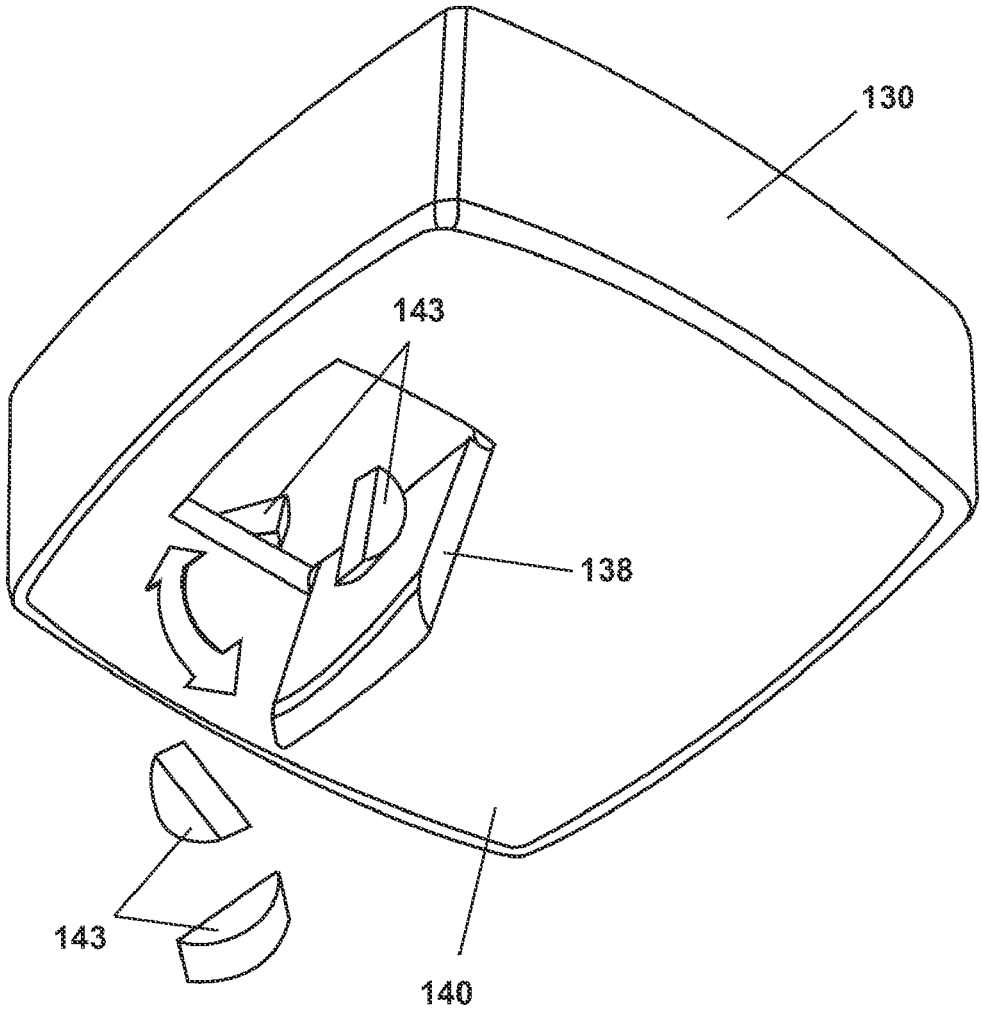
FIG. 6C is a partial perspective view of the ice storage bin of FIG. 6 showing the bottom of the ice cube storage bin with the movable door open.

FIGS. 6, and 6A to 6C illustrate one embodiment of an ice maker module 129 that can be used in the embodiment of FIG. 2. Ice maker module 129 can include an ice cube storage bin 130 that can extend forwardly from ice maker housing 132. Ice maker housing 132 can enclose an ice maker similar to ice maker 82 in the embodiment of FIG. 2. An auger 134 can be provided in ice cube storage bin 130 to move ice cubes exiting ice maker housing 132 through opening 136. Auger 134 can be a conventional auger well known for use in ice storage bins used in conjunction with ice dispensers and can be provided with a drive motor (not shown) as is well known in the art. Those skilled in the art will understand that ice maker module 129 can be provided with a control (not shown) for the ice maker and a drive motor (not shown). The control can be arranged to control operation of the drive motor (not shown) to operate auger 134 when a user operates the ice dispenser. At the forward portion of ice cube storage bin 130 a movable door 138 can be provided in bottom wall 140. Movable door 138 can be pivotally mounted to bottom wall 140 with a spring loaded pivot 142 sufficient to bias movable door 138 closed. When auger 134 operates ice cubes 143 are moved over movable door 138 and the weight of the ice cubes 143 can cause movable door 138 to open and drop the ice cubes 143 into a dispenser inlet as described above in connection with the embodiment of FIG. 2. Those skilled in the art will understand that bottom wall 140 can be sloped downwardly toward movable door 138 from the sidewalls of ice cube storage bin 130 to facilitate the movement of ice cubes toward auger 134. When auger 134 is operated ice cubes 143 can slide down sloped bottom wall 140 into auger 134, and then be carried forward by auger 134 to movable door 138. FIG. 6C illustrates ice cubes 143 falling through movable door 138 when auger 134 has operated to move ice cubes 143 to movable door 138. Those skilled in the art will understand that ice cube storage bin 130 and ice maker housing 132 can be enclosed in an insulated housing as described above in connection with FIG. 2. Those skilled in the art will also understand that portions of ice cube storage bin and/or ice maker housing can be part of the insulating housing and that an insulated cover (not shown) can be provided for the ice cube storage bin 130.

Figure 7A:
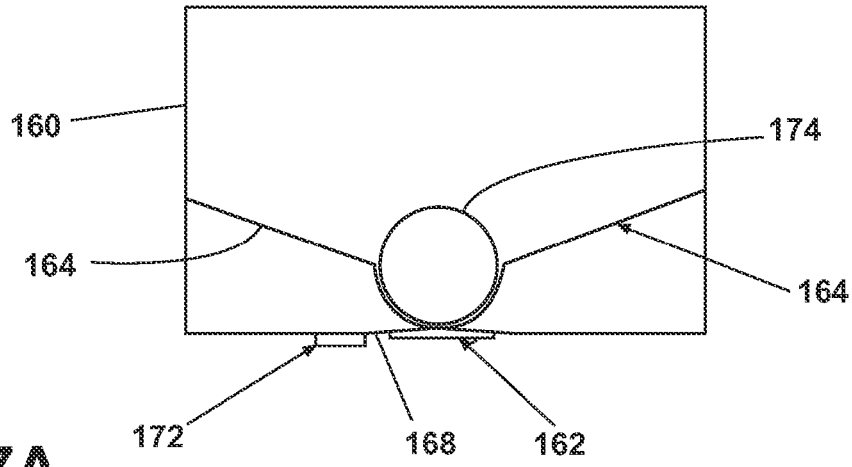
FIG. 7A is a schematic end view of the ice storage bin of FIG. 7 showing the bottom of the ice cube storage bin.
Figure 7B:
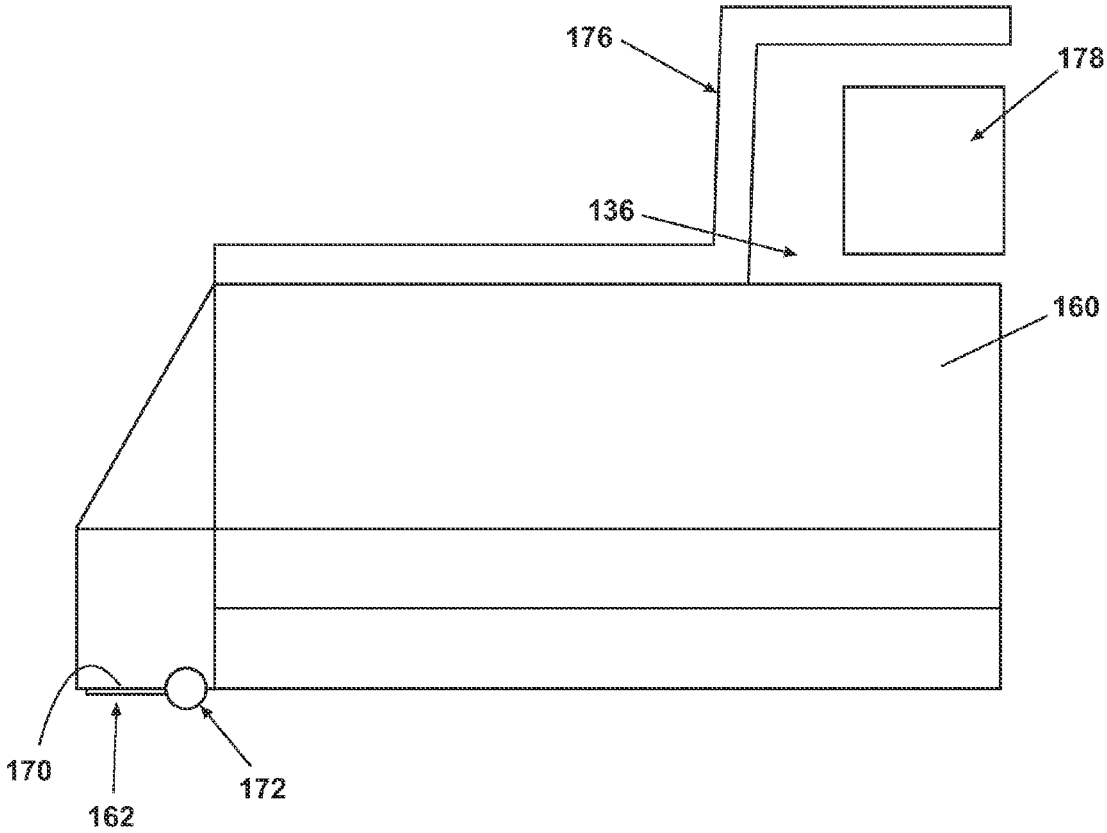
FIG. 7B is a schematic side view of the ice cube storage bin of FIG. 7A.

FIGS. 7, 7A and 7B illustrate another embodiment of an ice cube storage bin that can be used in the embodiment of FIG. 2. Ice cube storage bin 160 can be similar to ice cube storage bin 130 of the embodiment of FIGS. 6 and 6A to 6C and can be combined with an ice maker as disclosed in FIG. 6. Ice cube storage bin 160 can include a movable door 162 pivotally attached to sloped bottom wall 164. Movable door 162 can be mounted to axle 168 connected to motor 172. Motor 172 can be arranged to rotate axle 168 to cause movable door 162 to open. An auger 174 can be provided to operate as a mover in ice cube storage bin 160. A drive 175 can be provided for auger 174. A control 184 can be provided to operate motor 172 and a control 186 can be provided to operate auger drive 175 as is well known in the art. Controls 184 and 186 can be discrete controls or can be portions of other ice maker/ice dispenser/refrigerator controls as will be readily understood by those skilled in the art. In operation, motor 172 can be operated in conjunction with auger 174 so that ice cubes 143 moved toward movable door 162 can fall freely through the opening 170 in the bottom wall into an ice dispenser as described in the embodiment of FIG. 2. Those skilled in the art will understand that ice cube storage bin 160 can be enclosed in an insulated housing 176 as described above in connection with FIG. 2. Those skilled in the art will also understand that portions of ice cube storage bin can be part of the insulating housing and that an insulated housing can include the ice cube storage bin 160. Motor 172 and auger drive 175 can be operated by controls 184 and 186 that can be similar to the control described above in conjunction with the embodiment of FIG. 6. Ice maker 178 can be similar to ice maker 82 in the embodiment of FIG. 2. Opening 136 can allow ice cubes 143, not shown in FIGS. 7, 7A and 7B, to fall from ice maker 178 into ice cube storage bin 160.

Figure 7C:
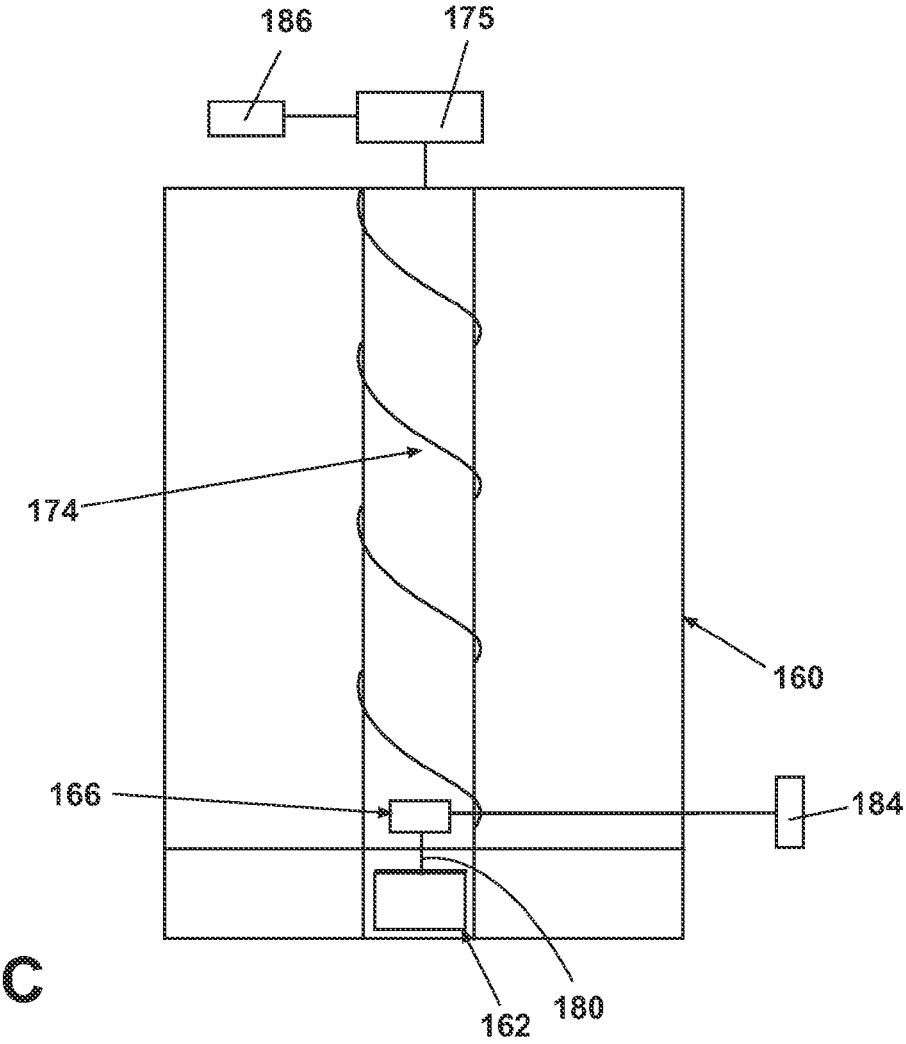
FIG. 7C is a schematic top view of an ice cube storage bin illustrating another embodiment of movable door operator.
Figure 7D:
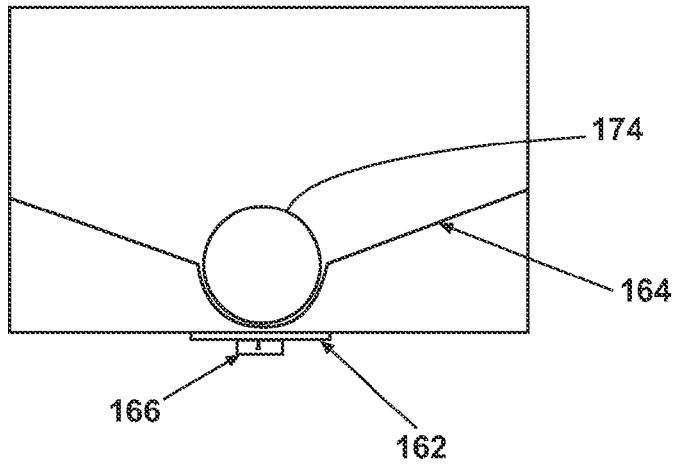
FIG. 7D is a schematic end view of the ice cube storage bin of FIG. 7C.
Figure 7E:
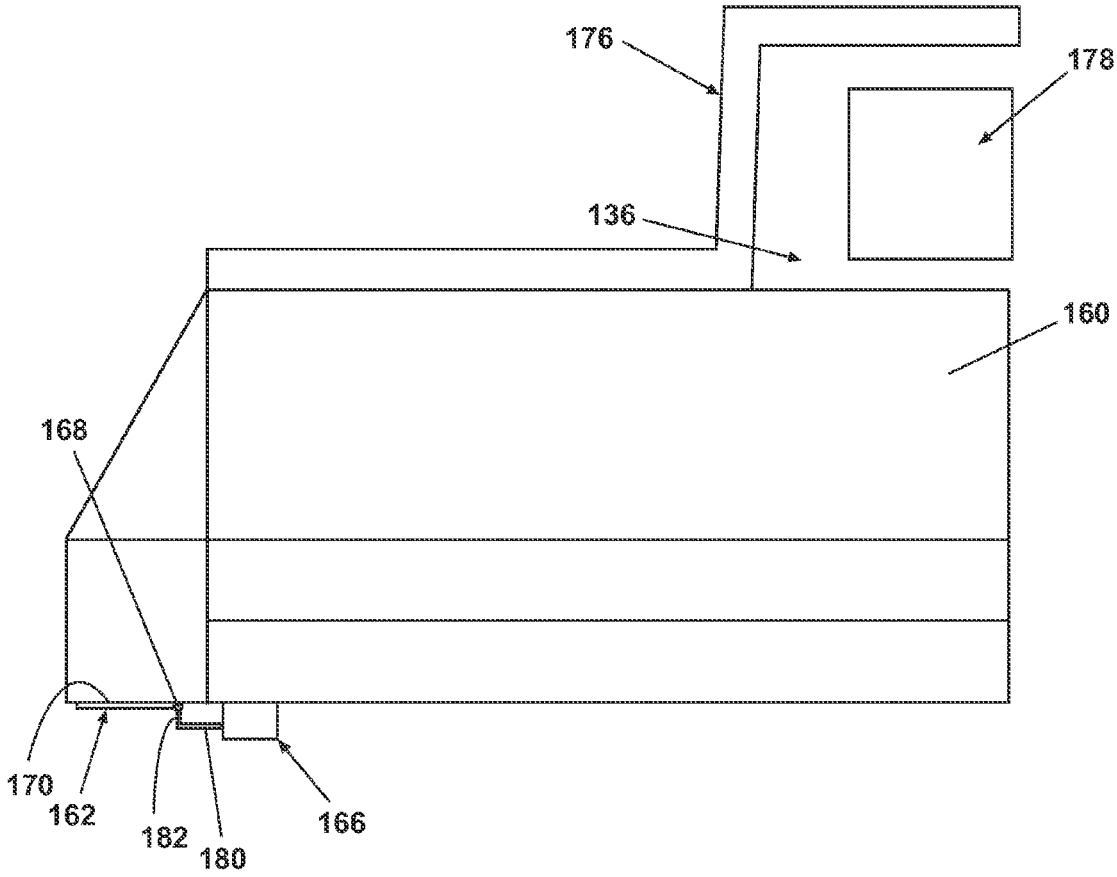
FIG. 7E is a schematic side view of the ice cube storage bin of FIG. 7C.

FIGS. 7C, 7D and 7E illustrate another embodiment of an ice cube storage bin that is similar to the ice cube storage bin of FIGS. 7, 7A and 7B that comprises another embodiment of an operator for movable door 162. Ice cube storage bin 160 can include a movable door 162 pivotally attached to sloped bottom wall 164. Movable door 162 can be mounted to axle 168 connected to solenoid 166. Solenoid 166 can be arranged to rotate axle 168 to cause movable door 162 to open. Solenoid 166 can include operator 180 that can be retracted when solenoid 166 is energized. Operator 180 can be connected to arm 182 at axle 168. When operator 180 is moved by solenoid 166 arm 182 an door 162 pivot allowing ice cubes to fall through opening 170 in ice cube storage bin 160. In operation, solenoid 166 can be operated in conjunction with an auger 174 so that ice cubes 143 moved toward movable door 162 can fall freely through the opening 170 in the bottom wall into an ice dispenser as described in the embodiment of FIG. 2. Those skilled in the art will understand that ice cube storage bin 160 can be enclosed in an insulated housing 176 as described above in connection with FIG. 2. Those skilled in the art will also understand that portions of ice cube storage bin can be part of the insulating housing and that an insulated housing can include the ice cube storage bin 160. Solenoid 166 can be operated by control 184 similar to the control described above in conjunction with the embodiment of FIG. 6.

The ice dispensers described above for use with the ice production and storage embodiments of the invention are described as being ice cube dispensers. Those skilled in the art that any of the dispensers and/or ice cube storage bin dispenser assemblies can be arranged to include well known apparatus to convert ice cubes to crushed or shaved ice if desired to afford users the choice of ice cubes, crushed ice or shaved ice.

The inventive concepts described herein provide the convenience of ice and water dispensing on the refrigerator door of a bottom freezer refrigerator. Since the refrigerator compartment is accessed more frequently than the freezer compartment, the refrigerator compartment occupies the upper portion of the cabinet, improving access to refrigerated items. The less-frequently accessed freezer compartment occupies the lower portion of the cabinet, extending the width of the cabinet. Unlike a side-by-side refrigerator, the full width freezer compartment can accommodate large items. The ice making assembly can be located in an insulated enclosure in the refrigerator compartment utilizing well-known ice making and through-the-door ice cube dispensing technology in refrigerators where the reduction and refrigerator space is not an issue.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

We claim:

1. A refrigerator comprising:

a cabinet defining a freezer compartment maintained at a temperature below 0° C. and a refrigerator compartment maintained at a temperature above 0° C. and located above the freezer compartment;

an insulated refrigerator door moveably mounted to the cabinet for selectively closing the refrigerator compartment;

a refrigeration system for cooling the freezer compartment and the refrigerator compartment;

a housing located in the refrigerator compartment enclosing an ice maker and an ice cube storage bin, the housing interior defining an auxiliary freezer compartment adjacent to the freezer compartment;

an ice dispenser located on the refrigerator door; and an ice cube dispensing outlet located in the refrigerator door;

wherein the auxiliary freezer compartment is maintained at a temperature below 0° C. for forming and storing ice cubes; and, wherein the refrigerator door closes the auxiliary freezer compartment when the refrigerator door closes the refrigerator compartment.

2. The refrigerator according to claim 1, wherein the ice dispenser is located on the refrigerator door opposite the ice cube storage bin.

3. The refrigerator according to claim 1, wherein the auxiliary freezer compartment further comprises a cooling element for cooling the housing interior below 0° C.

4. The refrigerator according to claim 3, wherein the cooling element comprises an air inlet for receiving air cooled below 0° C. for forming and storing ice cubes.

5. The refrigerator according to claim 3, wherein the cooling element comprises an evaporator located within the housing interior.

6. The refrigerator according to claim 5, wherein the automatic ice maker comprises an ice mold and the evaporator is in contact with the ice mold.

7. The refrigerator according to claim 1, wherein the auxiliary freezer compartment is located within the interior of the refrigerator compartment when the refrigerator door is closed.

8. The refrigerator according to claim 7, wherein the ice dispenser is located on the refrigerator door opposite the ice cube storage bin.

9. An ice maker and dispenser for a bottom freezer refrigerator comprising:

a freezer compartment maintained at a temperature below 0° C.;

a refrigerator compartment maintained at a temperature above 0° C. positioned above the freezer compartment;

an insulated refrigerator compartment door;

a refrigeration system for cooling the freezer compartment and the refrigerator compartment;

an insulated sub-compartment located in the refrigerator compartment and closed by the refrigerator door when the refrigerator door is closed;

an automatic ice maker in the sub-compartment for generating ice cubes;

a water supply for the ice maker;

an ice cube storage bin; and an ice dispenser positioned on the refrigerator door to receive ice cubes from the ice cube storage bin and dispense ice cubes from the face of the refrigerator door;

wherein the ice maker and ice cube storage bin are provided with air cooled below 0° C. for forming and storing ice pieces.

10. The ice maker and dispenser of claim 9, wherein the bottom freezer refrigerator further comprises gaskets for sealing the insulated maker sub-compartment to the refrigerator door when the refrigerator door is closed.

11. The ice maker and dispenser of claim 9, wherein the ice cube storage bin is positioned in the insulated sub-compartment below the ice maker for receiving ice cubes from the ice maker.

12. The ice maker and dispenser of claim 11, wherein the ice cube storage bin includes an auger for moving ice cubes to the front of the ice bin and delivering ice cubes to the ice dispenser.

13. An ice maker and dispenser for a bottom freezer refrigerator comprising:

a freezer compartment maintained at a temperature below 0° C.;

a refrigerator compartment maintained at a temperature above 0° C. positioned above the freezer compartment;

an insulated refrigerator compartment door;

a refrigeration system for cooling the freezer compartment and the refrigerator compartment;

an insulated sub-compartment located in the refrigerator compartment and closed by the refrigerator door when the refrigerator door is closed;

an automatic ice maker in the sub-compartment for generating ice cubes;

a water supply for the ice maker;

an ice cube storage bin; and an ice dispenser positioned on the refrigerator door to receive ice cubes from the ice cube storage bin and dispense ice cubes from the face of the refrigerator door;

wherein the ice maker and ice cube storage bin are provided with air cooled below 0° C. for forming and storing ice pieces; and wherein the insulated sub-compartment defines an auxiliary freezer compartment.

14. The ice maker and dispenser according to claim 13, wherein the insulated sub-compartment comprises a bottom wall that divides the sub-compartment from the freezer compartment.

15. The ice maker and dispenser according to claim 14, wherein the bottom wall comprises a shelf arranged to support items in the auxiliary freezer compartment and to allow air circulation from the freezer compartment into the auxiliary freezer compartment.

16. The ice maker and dispenser according to claim 14, wherein the bottom wall comprises an insulated wall.

17. The ice maker an dispenser according to claim 16, wherein the bottom freezer refrigerator further comprises an insulated compartment separator dividing the refrigerator compartment from the freezer compartment, and wherein the bottom wall forms part of the compartment separator.

18. The ice maker and dispenser according to claim 17, wherein the bottom wall has at least one passage connecting the auxiliary freezer compartment with the freezer compartment.

19. The ice maker and dispenser according to claim 18, wherein the auxiliary compartment further comprises a damper for selectively closing the passage.

20. The ice maker and dispenser according to claim 19, wherein the damper comprises a thermostatically controlled damper arranged to allow independent control of temperatures in the auxiliary freezer compartment and the freezer compartment.

21. The appliance according to claim 13, wherein the insulated maker sub-compartment further comprises a cooling element for cooling the insulated maker sub-compartment interior below 0° C.

22. The appliance according to claim 21, wherein the cooling element comprises an air inlet for receiving below 0° C. air from the freezer compartment to cool the insulated maker sub-compartment interior.

23. The appliance according to claim 21, wherein the cooling element comprises an evaporator located within the insulated ice maker sub-compartment interior.

24. The appliance according to claim 23, wherein the ice maker comprises an ice mold and the evaporator is in contact with the ice mold.

25. A refrigerator comprising:

a cabinet defining a freezer compartment maintained at a temperature below 0° C., and a refrigerator compartment maintained at a temperature above 0° C. and located substantially above the freezer compartment;

an insulated refrigerator door moveably mounted to the cabinet for selectively closing the refrigerator compartment;

an automatic ice maker for generating ice cubes located within a portion of the freezer compartment selectively closed by a portion of the refrigerator door;

an ice cube dispensing outlet located in the refrigerator door; and an ice dispenser operably connecting the ice maker to the dispensing outlet such that ice cubes generated by the ice maker are dispensed through the dispensing outlet.

26. The refrigerator according to claim 25, wherein the dispensing outlet is located in the portion of the refrigerator door that selectively closes the portion of the freezer compartment.

27. The refrigerator according to claim 26, wherein the ice dispenser is positioned in the portion of the freezer compartment when the refrigerator door is closed.

28. The refrigerator according to claim 27, wherein the cabinet further comprises a compartment separator dividing the refrigerator compartment from the freezer compartment, and the compartment separator has a step forming an upper portion in the freezer compartment that comprises the portion of the freezer compartment in which the ice maker is located.

29. The refrigerator according to claim 28, wherein the cabinet further comprises a wall that separates the portion of the freezer compartment from the remainder of the freezer compartment.

30. The refrigerator according to claim 29, wherein the refrigerator further comprises a seal that seals the refrigerator door to the wall.

31. The refrigerator according to claim 25, wherein the cabinet comprises a peripheral wall and a compartment separator dividing the interior of the cabinet to form the refrigerator compartment and the freezer compartment, and a freezer door for selectively closing the freezer compartment.

* * * * *

UNITED STATES PATENT AND TRADEMARK OFFICE

CERTIFICATE OF CORRECTION

PATENT NO. : 7,185,507 B2
APPLICATION NO. : 10/973509
DATED : March 6, 2007
INVENTOR(S) : Frank W. Maglinger et al.

It is certified that error appears in the above-identified patent and that said Letters Patent is hereby corrected as shown below:

Column 1, line 7, replace "US20030256" with --10/973,968--; line 8, "US20030429" should be changed to --10/973,874--; and line 8, "US20030432" should be changed to --10/973,542--.

Signed and Sealed this

Twenty-second Day of May, 2007

JON W. DUDAS
*Director of the United States Patent and Trademark Office*